United States Patent [19]

Martin et al.

[11] 4,140,054

[45] Feb. 20, 1979

[54] SAFETY DEVICES IN AN ELECTRONIC FRANKING MACHINE

[75] Inventors: Claude R. Martin, Saint Germain en Laye; Jacques Lallemand, Paris, both of France

[73] Assignee: Societe d'Etude et de Construction d'Appareils de Precision (S.E.C.A.P.), Boulogne-Billancourt, France

[21] Appl. No.: 851,210

[22] Filed: Nov. 14, 1977

[30] Foreign Application Priority Data

Jan. 7, 1977 [FR] France ..... 77 00317

[51] Int. Cl.[2] ..... B41L 47/46; B41L 47/56

[52] U.S. Cl. ..... 101/91; 235/132 R

[58] Field of Search ..... 101/91, 92; 235/101, 235/132 R

[56] References Cited

U.S. PATENT DOCUMENTS 3,978,457 8/1976 Check et al. ..... 101/91 X

FOREIGN PATENT DOCUMENTS 2335002 7/1977 France.
2354592 1/1978 France.

*Primary Examiner*—J. Reed Fisher
*Attorney, Agent, or Firm*—McDougall, Hersh & Scott

[57] ABSTRACT

Printing wheels carried by a printing drum which is driven in rotation during one cycle are manually set at the desired prepayment values for the purpose of franking postal envelopes, parcels and wrappers. Intermediate stopping of the machine can be effected if necessary on completion of a first part of the cycle prior to printing. Electronic means are provided for the acquisition of the prepayment value during the first part of the cycle, for the detection of fault conditions during operation, for the inhibition of the intermediate stopping means, and for transferring the prepayment value from the acquisition means to means for recording the total prepayment values.

6 Claims, 4 Drawing Figures

S
148
150
149
146
149
149
149
157
107
114
132
133
134
159
152
153
154
161
163
ET
ET
151
UE
SAL
131
145
158
137
TCH
165
136
SQ
162
164
ALU
138
166
156
143
TTOT
142
MTOT
US
141
144
150

SAFETY DEVICES IN AN ELECTRONIC FRANKING MACHINE

This invention relates to machines for franking mail envelopes and wrappers, comprising a movable component for supporting printing wheels which carry printing characters; a hand-operated mechanism for the value-setting of each printing wheel by means of a transmission system in which one element related to each printing character is associated with a device comprising detectors for emitting signals which are characteristic of the instantaneous position of said element; means for driving during one franking cycle the movable component for supporting the printing wheels; means for recording the total number of franking operations performed, said means being controlled in dependence on the movable component which supports the printing wheels and being provided with electronic means for recording the digits of at least a certain number of lower rows of the total. A machine of this type has already been described in French Pat. No. 2,335,002 filed in the name of the present Applicant.

The aim of the present invention is to improve the conditions of safety which are inherent in machines of this type.

In the machine described in the patent Application cited in the foregoing, it is intended to ensure that the franking operations should strictly correspond to the sums recorded. To this end, the component which serves to support the printing wheels, or in other words the printing drum, is permitted to rotate only in one direction whilst recording of the sums and the printing operation are carried out during one and the same revolution of said drum.

These expedients in fact make it possible to ensure that a single impression cannot give rise to more than one recording and conversely that a single recording cannot give rise to more than one impression. However, such expedients are not sufficient to ensure complete safety in the event of abnormal operation such as interruption of the power supply during a franking operation, a sudden failure of an electronic component, capacity overflow of the integrating counter or else attempted fraud by abnormal operation or the use of physical means.

The aim of the present invention is precisely to improve the safety devices of machines of the above-mentioned type in order to prevent any possibility of error in the counting operation, even in cases of abnormal operation.

To this end, the machine in accordance with the invention further comprises means for potential intermediate stopping of the movable component for supporting the printing wheels, normally in the active stopping position on completion of a first part of the franking cycle and prior to printing during the second part of said cycle; electronic means for acquisition of the prepayment value for a franking operation to be performed, said means being activated during the aforesaid first part of the franking cycle; electronic means for detecting fault conditions in the operation of the machine and especially means for detecting a deficiency in the supply voltage of the machine, means for detecting any overstepping of the maximum permissible temperature in the case of the different machine components, means for detecting improbability of the signals delivered by the detectors for detecting the positions of the elements connected to the printing wheels, and means for detecting any capacity overflow of the recording means if the acquired prepayment value were transferred to said recording means; means for inhibiting said potential intermediate stopping means activated in response to favorable information given by all the aforesaid fault detection means; and means for transferring the prepayment value from the acquisition means to the recording means in response to the performance of the aforesaid second part of the franking cycle. Thus in accordance with the invention, the cycle of the machine is divided into two parts. In a first part, the prepayment value is simply acquired by electronic means and other electronic means serve to ascertain whether all the conditions of correct operation are in fact satisfied. If no fault is detected at the end of this first part of the cycle, the control circuits then deliver a signal which is intended to permit the machine to begin the second part of its cycle during which there take place the printing of the franking impression and the final recording in the integrating counter of the prepayment sum which has already been acquired during the first part of the cycle.

If, on the contrary, a fault has been detected during the first part of the cycle, the signal which permits execution of the second part of the cycle is not given; the machine stops at the end of the first part of the cycle, printing is not carried out and the prepayment value is not taken into account in the integrating counter. The machine is then returned to the starting point of the cycle and the operations are started again. Depending on the nature of the incident such as, for example, an accidental interruption of the power supply during the beginning of the cycle, the machine is once again in the operating condition if the power supply is restored. On the contrary, if the maximum permissible temperature has been exceeded, for example, the machine will remain locked in the inoperative state until it has been overhauled.

A more complete understanding of the invention will be gained from the following description and from the accompanying drawings in which one embodiment of an improved franking machine in accordance with the invention is shown by way of example without any limitation being implied, and in which.

Figures 1, 2, 4:
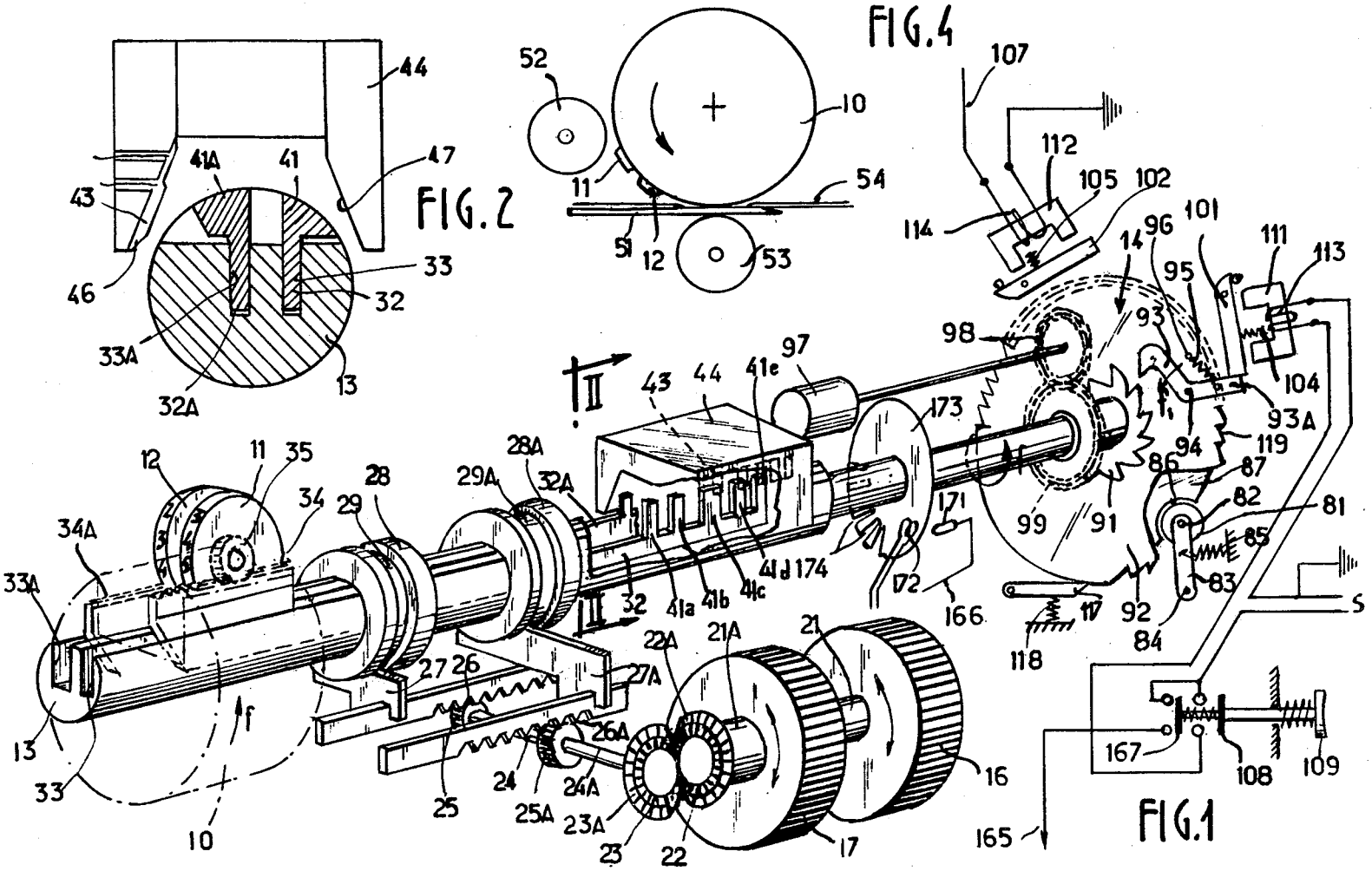
FIG. 1 is a view in perspective showing the basic components of the machine in the stationary position in which it has been assumed for the sake of enhanced clarity that the printing drum is provided only with characters for printing the units of prepayment values and with characters for printing tens.
FIG. 2 is a sectional view to a larger scale taken along line II—II of FIG. 1.
FIG. 4 shows the position of the printing wheels at the end of the first part of the cycle.

As in the case of many conventional franking machines, the franking machine which is partially illustrated in FIG. 1 comprises a printing drum shown only diagrammatically in chain-dotted lines at 10. Said drum carries stationary printing elements and variable printing elements which are all etched in relief. Among the variable printing elements, there is shown only a wheel 11 for printing the units of the prepayment or franking values and a wheel 12 for printing the tens. It is readily apparent that the machine further comprises a number of other printing wheels such as, for example, two additional wheels for printing the hundreds and the thousands respectively. The printing wheels are rotatably mounted within the drum 10 and this latter is keyed on a rotary shaft 13 which is driven in the direction of the arrow f so as to make one revolution during each franking operation by means of a special clutch of conventional type which is generally designated by the reference 14 and to which further reference will be made hereinafter.

Two manual control knobs 16, 17 permit the respective value-setting of the two printing wheels 11, 12 by means of suitable transmission systems.

The transmission system which couples the control knob 16 to the printing wheel 11 comprises a shaft 21 which is rigidly fixed to the control knob 16, a bevel pinion 22 keyed on the shaft 21, another bevel pinion 23 disposed in mesh with the pinion 22 and keyed on a shaft 24, a pinion 25 keyed on the shaft 24, a toothed rack 26 in mesh with the pinion 25, a support bracket 27 which is rigidly fixed to the toothed rack 26, a ring 28 which is capable of sliding on the shaft 13 and has an annular channel 29 in which is engaged the support bracket 27, a bar or sliding member 32 (as also shown in FIG. 2) which is capable of sliding within a longitudinal groove 33 of the shaft 13, a toothed rack 34 rigidly fixed to the sliding member 32 and a pinion 35 disposed in meshing engagement with the toothed rack 34 and rigidly fixed to the printing wheel 11.

The transmission system which couples the value-setting knob 17 to the printing wheel 12 is similar to the system which has just been described for the value-setting of the printing wheel 11. The corresponding components are designated by the same reference numerals to which is assigned the index "A".

The machine is equipped with a coding system for reading the instantaneous position of each sliding member or bar.

By way of example, the machine can be of the type described in the French Pat. No. 2,354,592 which has been filed by the present Applicant and to which reference can usefully be made.

Thus the sliding member 32 carries five teeth 41*a*, 41*b*, 41*c*, 41*d*, 41*e* and the sliding member 32A similarly carries five teeth 41A*a*, 41A*b*, 41A*c*, 41A*d*, 41A*e*. The corresponding teeth of the two sliding members 32, 32A are aligned in the same plane which is transverse to the shaft 13 in respect of one and the same value which is displayed on the printing wheels 11 and 12. Five magnetoresistive cells 43 are suitably arranged in rows parallel to the shaft 13 and integrated in a common fixed magnetic circuit 44 (as shown in FIGS. 1 and 2) which extends over the entire length of the useful travel of the teeth such as those designated by the references 41*a*–41*e*. The magnetic circuit 44 through which a flux passes continuously is constituted by a permanent magnet, for example.

When the machine is in its position of rest as shown in FIGS. 1 and 2, the shaft 13 occupies the angular position in which none of the teeth mentioned above is present in front of the magnetoresistive cells. During operation, the movement of rotation of the shaft 13 causes a certain number of teeth to pass in front of a certain number of magnetoresistive cells. In point of fact, magnetoresistive cells have the property of setting-up a resistance to the electric current, said resistance being variable as a function of the magnetic flux which surrounds said cells. Thus the cells which are located opposite to teeth undergo variations in resistance. These variations are utilized in electronic circuits in accordance with any desired code in order to ensure efficient performance of a franking cycle as will become apparent hereinafter.

The clutch 14 comprises a ratchet wheel 91 which is mounted to rotate freely on the shaft 13 against a circular disc 92. Said disc is rigidly fixed to said shaft and carries a pawl lever 93 which is intended to cooperate with the ratchet wheel 91. The pawl lever 93 is capable of pivoting on a pin 94 fixed on the disc 92 and is urged in the direction of the arrow f1 which causes said pawl lever to engage with the teeth of the ratchet wheel 91 by means of a spring 95. One end of said spring is attached to a point 96 of the disc 92 and the other end of the spring is attached to an extension 93A of the pawl lever 93.

The ratchet wheel 91 can be driven in rotation from a motor 97 in continuous motion in the direction of the arrow f, by means of a transmission system shown diagrammatically in the form of a toothed wheel 98 so arranged as to drive another toothed wheel 99 which is rigidly fixed to the ratchet wheel 91. The shaft 13 is resiliently locked in its normal angular stop position by means of a roller 81 which is loosely mounted on a shaft 82 carried by one end of a lever 83, the other end of which is pivotally mounted on a stationary pin 84. A spring 85 urges the spring 83 in the direction which engages the roller 81 within a recess 86 formed in the edge of a circular disc 87 which is rigidly fixed to the shaft 13.

A non-return pawl 117 is continuously urged by a spring 118 against a set of teeth 119 of the disc 92 in order to prevent this latter and consequently to prevent the shaft 13 of the machine from rotating in the direction opposite to the arrow f. However, the set of teeth 119 extends only over that portion of the periphery of the disc 92 which passes in front of the pawl 117 during the second part of the cycle. In other words, during the first part of the cycle, the pawl 117 bears on a smooth portion of the edges of the disc 92 and permits reverse motion of the shaft 13 for reasons which will be explained below.

Two retractable abutment members 101, 102 are located on the path of the extension 93A of the pawl lever 93 which constitutes a retaining element. The abutment member 101 determines the normal stop position of the machine at the end of each cycle whilst the abutment member 102 is a potential intermediate-stopping abutment member; this latter is placed in the position occupied by the retaining element 93A at the moment of completion of the first predetermined part of the cycle during which acquisition of the prepayment value is effected.

The normal-stopping abutment member 101 is urged elastically by a spring 104 towards its active position in which it stops the retaining elememt 93A whereas the other abutment member for potential intermediate stopping at the end of the first part of the cycle is urged towards its active position by a spring 105.

The two retractable abutment members 101, 102 constitute the moving armatures of two electromagnets 111, 112 respectively, the exciting coils of which are designated by the references 113, 114. The coil 113 of the electromagnet 111 is supplied from a current source S by means of a contact 108 of an electrical switch 109 of the push-button type. This switch has an auxiliary contact 167 which closes before the contact 108 and serves to supply a conductor 165 for the initiation of the cycle as will be explained below. The coil 114 of the electromagnet 112 is supplied by means of a conductor 107 to which further reference will also be made hereinafter.

Figure 3:
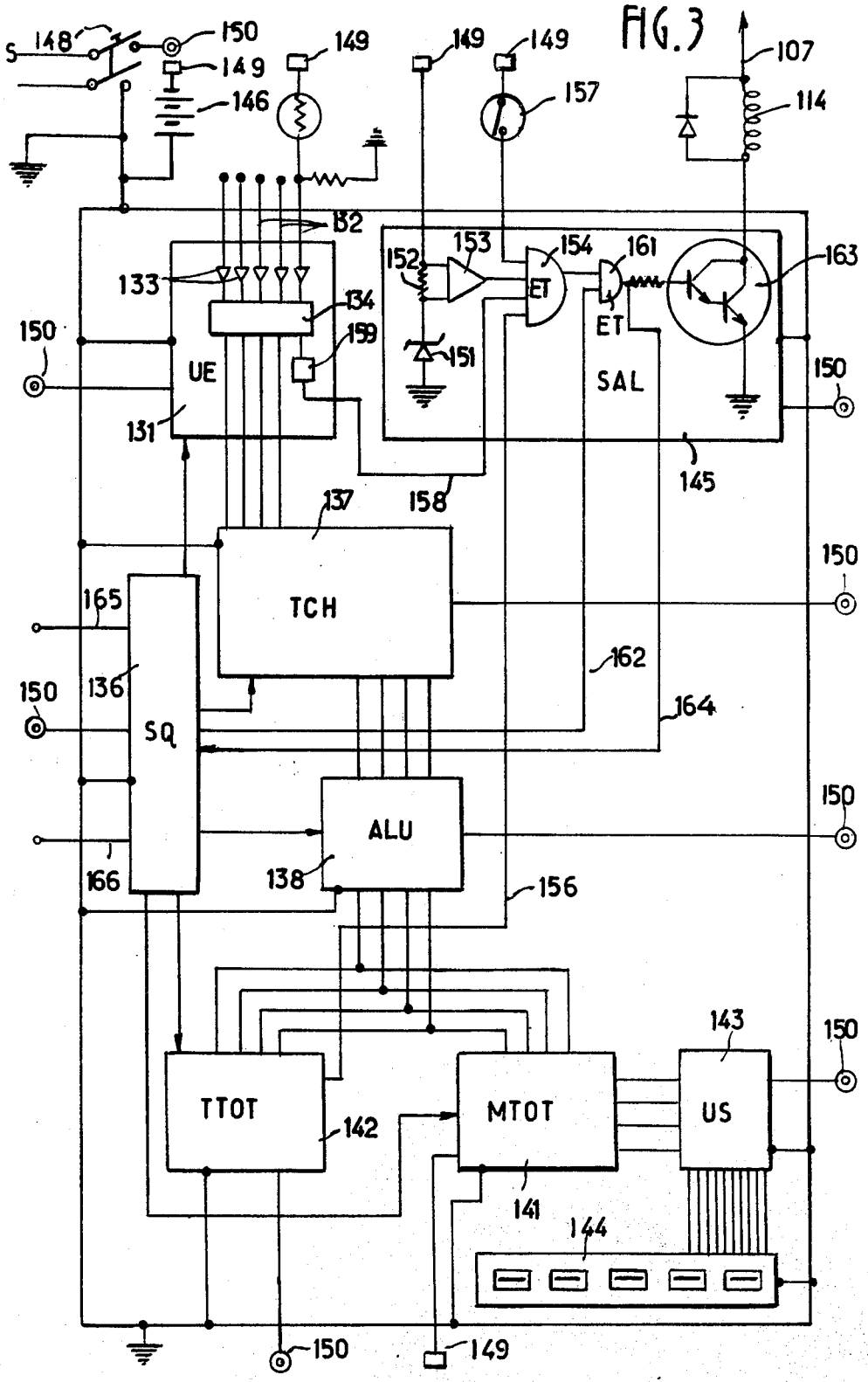
FIG. 3 is a diagram of the electronic circuits of the machine.

The electronic circuits of the machine are shown in FIG. 3 and comprise:

an input unit 131 (UE) having parallel inputs on five leads connected respectively to the five magnetoresistive cells 43; this input unit comprises the five amplifiers 133 which are necessary in order to convert the input signals to logical signals, and a transcoder 134 for converting the codes of the ten digits 0 to 9 derived from the coder 43 to the binary code and for detecting any improbable input code combinations resulting from errors;

a sequencer 136 having the design function of giving instructions to the different electronic circuits for the successive execution of the different operations required for carrying out a franking cycle;

a buffer register 137 (TCH) which is capable of storing in memory the four digits constituting the prepayment value;

an arithmetic and logic unit 138 (ALU);

two summing registers 141 (MTOT) and 142 (TTOT) which are each capable of storing ten decimal digits; the register 142 (TTOT) is an intermediate register provided with a circuit for potential detection of recording capacity overflow;

an output unit 143 (US) for transmitting the data contained in the register 141 (MTOT), if necessary to a display device 144;

and an alarm unit 145 (SAL).

The complete assembly of electronic circuits is supplied on the one hand from a dry cell 146 incorporated in the machine and on the other hand from an external source S by means of a switch 148. One pole of the dry cell and of the external source is connected to the ground of the electronic circuits whilst the other pole represented in the diagram by a terminal 149 having the shape of a square or a terminal 150 having the shape of a double circle respectively is connected to the corresponding portions of the electronic circuits.

The alarm unit 145 constitutes the fault detection means and comprises:

a circuit for detecting deficient voltage of the dry cell 146 with a Zener diode 151 and a resistor 152; a voltage appears at the terminals of said resistor when the threshold of the diode is attained and when a current therefore passes through said resistor; the threshold of the diode is chosen so as to correspond to a sufficient voltage of the dry cell to ensure correct operation of the machine; after processing in an amplifier 153, the voltage appearing at the terminals of the resistor 152 is delivered to the input of a first AND-gate 154;

a circuit for the detection of any possible capacity overflow of the register 141 for recording the total number of franking operations desired, as indicated in the diagram by a connection 156 between the intermediate summing register 142 and also the input of the first gate 154;

a circuit for detecting overstepping of the maximum permissible temperature for the different machine components with a thermal trip switch 157 supplied by the dry cell 146 and connected to another input of the first gate 154;

a circuit for detecting improbability of signals delivered by detectors for the position-detection of the elements connected to the printing wheels, as represented in the diagram by a connection 158 through which the state of a memory 159 of the transcoder 134 of the input unit 131 is transmitted to another input of the first gate 154.

The output of the first AND-gate 154 is connected to the input of a second AND-gate 161 to which is also transmitted the information delivered by the sequencer 136 at the moment of initiation of the second part of the cycle, as represented by the connection 162.

The output of the second AND-gate 161 is connected by means of a transistor amplifier 163 to the exciting coil 114 of the electromagnet 112 for initiating the withdrawal of the intermediate-stopping abutment member 102.

The sequencer 136 can receive two types of signals as indicated in the diagram of FIG. 3 by the two inputs 165, 166. The input 165 corresponds to zero-resetting of the machine (but clearly not including the general recording counter 141), the signal being produced by the initial auxiliary contact 167 of the start-up control push-button 109 (shown in FIG. 1). The other input 166 of the sequencer 136 (shown in FIG. 3) is activated by a photosensitive cell 171 (shown in FIG. 1) which is subjected to the influence of a permanent light source 72, the beam of which is controlled by a slotted disc 173 keyed on the rotary shaft 13. Provision is made for five slots 174, namely four slots which pass in front of the light source 172 respectively at the instants at which the teeth such as 41A–41E of the sliding members such as the member 32 pass in front of the magnetoresistive cells 43, and an additional slot which follows the last of these four slots.

The operation of the machine is as follows:

In order to frank a postal consignment, the initial operation consists in setting the printing wheels 11, 12 at the requisite prepayment value by means of the manual control knobs 16, 17. The push-button 109 is depressed, the contact 167 is closed, the sequencer 136 is consequently reset to zero and initialized, the contact 108 closes in turn and delivers a current pulse into the coil 113 of the electromagnet 111 which attracts the retractable abutment member 101. Under the action of the spring 95, the pawl lever 93 engages between the teeth of the ratchet wheel 91 which is already moving continuously in rotation in the direction of the arrow f. The disc 92 therefore begins to be driven in rotation in the same direction by the pawl lever 93 together with the shaft 13 and all the elements carried by this latter, especially the drum 10 and the printing wheels 11, 12.

During the first part of the complete revolution to be performed by the drum 10 for carrying out a franking cycle, the first pulse delivered by the photosensitive cell 171 (shown in FIG. 1) as the first slot of the disc 173 passes in front of this latter has the effect of positioning the sequencer 136 in the stage of acquisition of the first digit of the prepayment value. Thus the coder comprising photoresistive cells 43 in front of which the teeth **41*a*–41*e* of the sliding member 32 are caused to pass transmits the coded value of the first digit aforesaid at this instant to the input unit 131 (shown in FIG. 3) in which said value is checked, passed into the transcoder 134 and transferred to the buffer register 137 (TCH). The three other digits of the prepayment value are processed in the same manner at the corresponding instants of transfer of the teeth of the three other sliding members in front of the photoresistive cells 43 of the coder and at the instants of transfer of the three following slots 174 of the disc 173 in front of the cell 171**.

Transfer of the fifth slot 174 of the disc 173 in front of the cell 171 has the effect of delivering into the sequencer 136 a pulse which initiates calculation by the unit 138 (ALU) of the sum of the contents of the two registers 141 (MTOT) and 137 (TCH) as well as storage of the result in the summing register 142 (TTOT). The sequencer 136 then controls the alarm unit 145 through the lead 162 in order to check whether any fault condition is present.

Two basic assumptions are possible at this instant, depending on whether there exist either no fault conditions or else one (or a number) of fault conditions.

The first assumption is of course the one that prevails as a general rule. In this case the two AND-gates 154 and 161 permit on the one hand the supply of the coil 114 of the electromagnet 112 and on the other hand the continuation of the operation performed by the sequencer 136 by means of the connection shown at 164. The position-setting of the fifth slot 174 of the disc 173 is such that the electromagnet 112 is energized until the moment when the retaining element 93A of the pawl lever 93 passes opposite to the end of the retractable potential intermediate-stopping abutment member 102. The drum 10 of the machine is therefore not stopped and the second part of the cycle can take place; the pawl 117 slides over the set of teeth 119 of the disc 92 in order to prevent any reverse motion of the drum during this second part of the cycle. The prepayment value is printed on the envelope or wrapper. At the same time, the sequencer 136 initiates transfer of the contents of the intermediate register 142 (TTOT) into the register 141 (MTOT) and this latter activates the output unit 143 and its device 144 for indicating the total of the prepayment values which have actually been franked.

It will now be postulated that a fault condition has occurred in the operation of the machine when the printing drum 10 is about to complete the first part of its revolution and that at least one of the fault detection means has been activated. In consequence, the first gate 154 does not open and therefore cannot inform the second gate 161; when this latter receives the signal from the photosensitive cell 171, the second gate therefore does not open and the coil 114 of the electromagnet 112 is not energized. The potential intermediate-stopping abutment member 102 is not withdrawn and prevents further travel of the retaining element 93A. The printing drum 10 stops and the second part of the revolution is not carried out. The printing wheels such as those designated by the references 11, 12, for example have not yet reached the object to be franked such as the letter 51, for example; they occupy the position shown in FIG. 4 in which there has also been shown the inking roller 52, the impression roller 53 and the ink cell or cup 54.

At the same time, the second AND-gate 161 does not permit the sequencer 136 to continue the process, with the result that the franking or prepayment value which had simply been acquired by the electric circuits and stored in the register 142 (TTOT) during the first part of the cycle is not transferred to the register 141 (MTOT) which retains its previous total and does not modify the total indicated to the display device 144.

The fault condition may only have been transient. In order to ascertain this, the printing drum 10 is rotated by hand in reverse in order to return the drum to its position at the beginning of the cycle and a cycle is started again. Two cases can accordingly arise: if the fault condition has disappeared, the complete cycle takes place in the normal manner but if it still exists, the cycle will again stop at the end of its first part. It is then necessary to determine the cause of the defect and to take remedial action.

It can also happen that a failure of the power supply occurs at a moment such that the retractable intermediate-stopping abutment member 102 has been overstepped under normal conditions; the value of the postage stamp has therefore been recorded and it is important to ensure that the franking operation can be performed even if the power supply has not been restored. This is in fact possible since it is only necessary to rotate the drum by hand in the normal direction until it reaches its stop position at the end of the cycle in order to frank the envelope or wrapper. Rotation of the drum can be resumed when conditions have returned to normal.

It is worthy of note that, if the drum had stopped very shortly after the potential intermediate-stopping abutment member 102, it is then possible to return the drum to its starting position either by rotating this latter in the normal direction or in reverse, thus resulting in the loss of a franking value. In fact, however, this case would be likely to arise only in the event of an operation performed with fraudulent intent since the control pulse of the electromagnet 112 need only be calibrated in time in order to make it possible to pass beyond said abutment member only if the drum is driven at a speed which is close to its normal speed. Under these conditions, the inertia of the machine is such that this latter cannot stop of its own accord in less than a few tens of degrees and stopping of the drum can never take place in the zone which immediately follows the safety-stopping point except in the event of fraudulent operation.

As can readily be understood, the invention is not limited to the embodiment hereinabove described with reference to the accompanying drawings. Depending on the applications which may be contemplated, many modifications can accordingly be made without thereby departing either from the scope or the spirit of the invention.

From this it accordingly follows that, in the example herein described, potential intermediate stopping at the end of the first part of the cycle is produced by means of an intermediate retractable abutment member 102 which is provided in addition to the retractable abutment member 101 for normal stopping at the end of a cycle, both abutment members being adapted to cooperate with a single common retaining element 93A carried by the drum. However, potential intermediate stopping could be carried out in any suitable manner, for example by means of the retractable abutment member for normal stopping at the end of a cycle. Provision is in that case made for a single abutment member which is controlled at the proper time by suitable means in order to cooperate if necessary with an additional retaining element for potential intermediate stopping, said element being carried by the drum and angularly keyed with respect to this latter in a suitable manner.

We claim:

1. A machine for franking postal envelopes and wrappers, comprising a movable component for supporting printing wheels which carry printing characters; a hand-operated mechanism for the value-setting of each printing wheel by means of a transmission system in which one element related to each printing character is associated with a device comprising detectors for emitting signals which are characteristic of the instantaneous position of said element; means for driving during one franking cycle the movable component for supporting the printing wheels; means for recording the total number of franking operations performed, said means being controlled in dependence on the movable component which supports the printing wheels and being provided with electronic means for recording at least a certain number of digits of the lower rows of the total, wherein said machine further comprises means for potential intermediate stopping of the movable component for supporting the printing wheels, normally in the active stopping position on completion of a first part of the franking cycle and prior to printing during the second part of said cycle; electronic means for acquisition of the set value for a franking operation to be performed, said means being activated during the aforesaid first part of the franking cycle; electronic means for detecting fault conditions in the operation of the machine and especially means for detecting a deficiency in the supply voltage of the machine, means for detecting any overstepping of the maximum permissible temperature in the case of the different machine components, means for detecting improbability of the signals delivered by the detectors for detecting the positions of the elements connected to the printing wheels, and means for detecting any capacity overflow of the recording means if the acquired set value were transferred to said recording means; means for inhibiting said potential intermediate stopping means activated prior to completion of the first part of the cycle in response to favorable information given by all the aforesaid fault detection means; and means for transferring the set value from the acquisition means to the recording means in response to initiation of the aforesaid second part of the franking cycle.

2. A machine according to claim 1, wherein the potential intermediate-stopping means are constituted by a retractable abutment member normally placed on the path of a retaining component rigidly fixed to the supporting element for the printing wheels, said abutment member being subjected to the action of the aforesaid inhibiting means constituted by an electromagnet for controlling the withdrawal of said abutment member in which the coil of said electromagnet is energized by a circuit supplied in response to the favorable information given by all the aforesaid electronic fault detection means.

3. A machine according to claim 2, wherein the retaining element is constituted by an extension of a pawl lever carried by a member which is rigidly fixed to the component for supporting the printing wheels and is adapted to cooperate with a ratchet wheel driven continuously for one revolution so as to form a clutch of conventional type.

4. A machine according to claim 1, wherein said machine comprises a non-return device adapted to cooperate with the movable component for supporting the printing wheels and adapted to prevent reverse motion of said component in the aforesaid second part of the franking cycle.

5. A machine according to claim 4, wherein the non-return device aforesaid is constituted by a pawl urged elastically against a set of teeth which is connected to the movable component for supporting the printing wheels and which moves in front of said pawl during execution of the second part of the franking cycle.

6. A machine according to claim 1, wherein the electronic means of the machine comprise on the one hand six assemblies, namely: an input unit, a buffer register, an arithmetic and logic unit, an intermediate summing register, a recording and summing register with an output unit and its display device, and an alarm unit and, on the other hand, a sequencer connected to each of the six assemblies aforesaid and also connected to a contact for delivering a pulse which initiates the first part of the cycle and to a device for emitting synchronizing pulses in which one element is in rigidly fixed relation to the movable components for supporting the printing wheels, the alarm unit being provided with an output circuit for the information of the sequencer and for initiating the second part of the cycle and energizing means which exhibit potential intermediate-stopping means in response to the output current of an AND-gate having a number of inputs connected respectively to the means for detecting fault conditions in the operation of the machine.

* * * * *

UNITED STATES PATENT OFFICE

CERTIFICATE OF CORRECTION

Patent No. 4,140,054 Dated February 20, 1979

Inventor(s) Claude R. Martin and Jacques Lallemand

It is certified that error appears in the above-identified patent and that said Letters Patent are hereby corrected as shown below:

Col. 4, line 26, 2nd instant, change "spring" to -- lever --.

Col. 6, line 24, change "72" to -- 172 --.

Col. 9, line 40, change "element" to -- component -- .

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*